US006031321A

United States Patent [19]

Park

[11] Patent Number: 6,031,321

[45] Date of Patent: Feb. 29, 2000

[54] INFRARED THERMAL LAMP

[76] Inventor: Shi-Heung Park, Samhwan Apartment 1109 - 1404, Yimae-dong 99, Pundang-ku, Sungnam-City, Kyounggi-Do, Rep. of Korea

[21] Appl. No.: 09/062,707

[22] Filed: Apr. 20, 1998

[51] Int. Cl.[7] ..... H01J 1/88

[52] U.S. Cl. ..... 313/275; 313/271; 313/238; 313/315

[58] Field of Search ..... 313/315, 326, 313/333, 331, 332, 238, 239, 240, 242, 271, 275, 277, 281

[56] References Cited

U.S. PATENT DOCUMENTS 3,857,056 12/1974 Miller et al. ..... 313/275
4,138,623 2/1979 McMillan ..... 313/332
4,272,702 6/1981 Teshima et al. ..... 313/174
5,659,222 8/1997 Ragsdale et al. ..... 313/275

*Primary Examiner*—Nimeshkumar D. Patel
*Assistant Examiner*—Mariceli Santiago
*Attorney, Agent, or Firm*—Armstrong, Westerman, Hattori, McLeland & Naughton

[57] ABSTRACT

An infrared thermal lamp, which has a filament mounted to the lower end of a support rod downwardly extending from a stem of a base, is disclosed. The infrared thermal lamp includes an insulating plate having an anchoring slot at the center for receiving the lower end of the support rod in a semi-melted state. Thus, the insulating plate is fixedly mounted to the support rod, and the anchoring slot is opened at the top end and is closed at the bottom end and has an enlarged diameter at the bottom end, thereby improving productivity, saving labor, automating the mounting process of the insulating plate, and reducing production cost.

1 Claim, 2 Drawing Sheets

INFRARED THERMAL LAMP

BACKGROUND OF THE INVENTION

1. Field of the Invention

The present invention relates to, in general, an infrared thermal lamp emitting a high thermal energy, and more particularly, to an infrared thermal lamp provided with an insulating plate easily mounted inside of the lamp, thereby improving productivity, saving labor, automating the mounting process of the insulating plate, and reducing production cost.

2. Description of the Prior Art

As well known to those skilled in the art, thermal energy of about 200° C. is emitted from an infrared thermal lamp and the infrared thermal lamp is utilized for local heating applications such as in a sauna parlor of a bathhouse, a cattle shed or a bathroom of a home, etc. While using such an infrared thermal lamp, the high interior thermal energy passes from a filament to an upper part of the lamp. Therefore, a stem and a support rod may be melted during the transmitting of the high thermal energy, and an anchor embedded in the support rod may be separated from the support rod. As a result, the anchor sometimes fails to hold the filament, thus causing the filament to unexpectedly break and forcing the owner to purchase a new infrared thermal lamp.

In order to overcome the above problems, an infrared thermal lamp as shown in FIG. 4 is proposed. The infrared thermal lamp includes a support rod 1, a filament 2 and an insulating plate 3, etc. The insulating plate 3, which is made of a heatproof material such as ceramic, is located between the support rod 1 and the filament 2. In order to mount the insulating plate 3 between the support rod 1 and the filament 2, an anchor 4 having a specifically-bent shape is used for suspending the filament 2 so that the insulating plate 3 may be somewhat easily mounted to the bent anchor 4. However, the process of the bending of the anchor 4 and of fixing the insulating plate 3 has to be manually carried out due to the structure of the infrared thermal lamp A. Therefore, the above infrared thermal lamp is problematic in that operational efficiency is decreased while wasting labor and increasing the unit cost of production.

SUMMARY OF THE INVENTION

Accordingly, the present invention has been made with the above problems occurring in the prior art in mind, and an object of the present invention is to provide an infrared thermal lamp for allowing an insulating plate to be easily mounted inside of the lamp, thereby improving productivity, saving labor, automating the mounting process of the insulating plate, and reducing production cost.

In order to accomplish the above object, the present invention provides an infrared thermal lamp including a filament mounted to the lower end of a support rod downwardly extending from a stem of a base, which comprises an insulating plate having an anchoring slot at the center for receiving the lower end of the support rod in a semi-melted state, thus being fixedly mounted to said support rod, the anchoring slot being opened at the top end and being closed at the bottom end and having an enlarged diameter at the bottom end.

BRIEF DESCRIPTION OF THE DRAWINGS

The above object, and other features and advantages of the present invention will be more clearly understood from the following detailed description taken in conjunction with the accompanying drawings, in which.

DESCRIPTION OF THE PREFERRED EMBODIMENT

Figure 1:
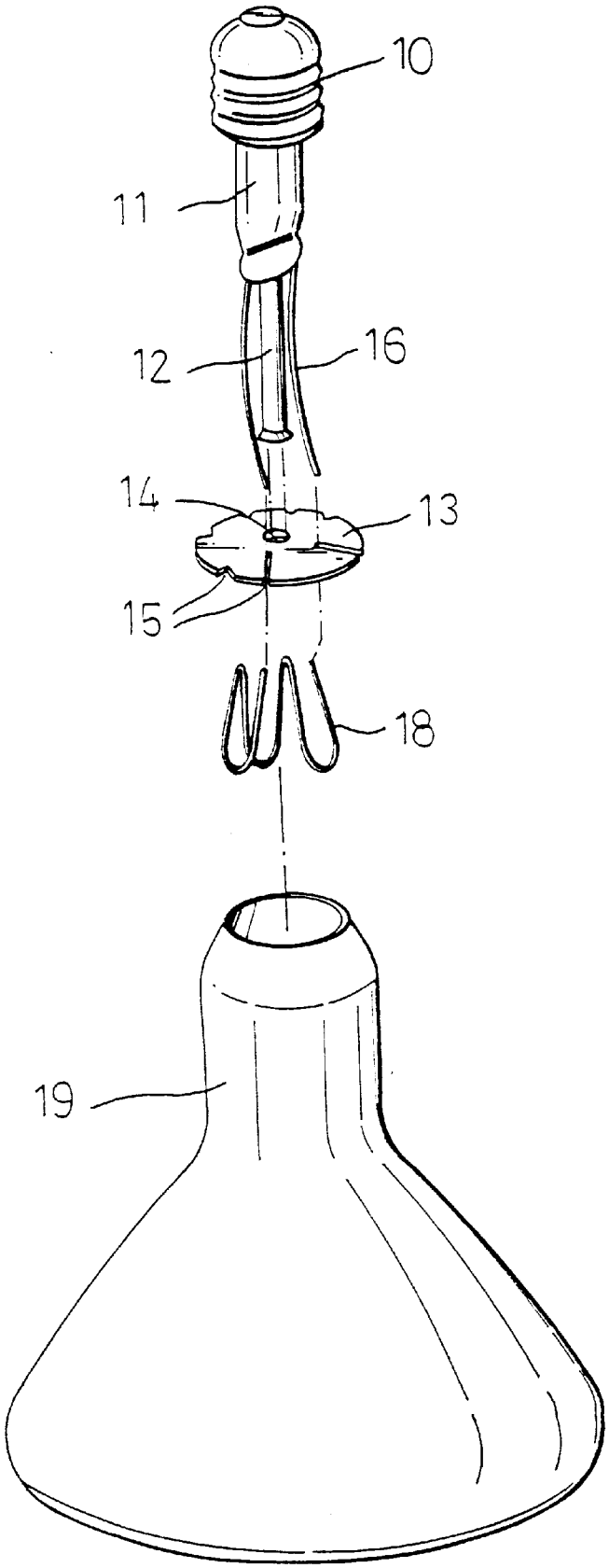
FIG. 1 is a exploded perspective view of an infrared thermal lamp in accordance with the preferred embodiment the present invention.
Figure 2A:
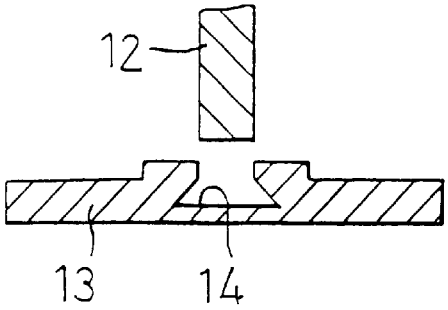
FIG. 2*a* is a cross-sectional view showing a support rod aligned with an insulating plate prior to cohesion according to an embodiment of the present invention.
Figure 2B:
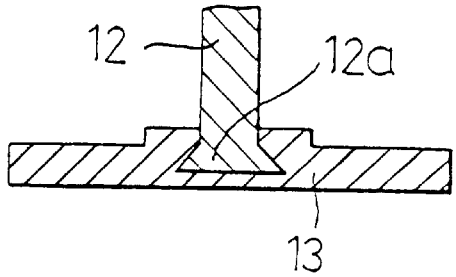
FIG. 2*b* is a cross-sectional view showing the support rod with the insulating plate of FIG. 2*a* after cohesion.
Figure 3:
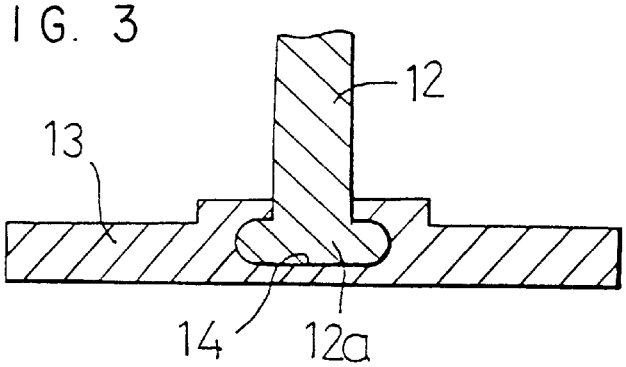
FIG. 3 is a cross-sectional view showing a support rod with an insulating plate after cohesion in accordance with another embodiment of the present invention.
Figure 4:
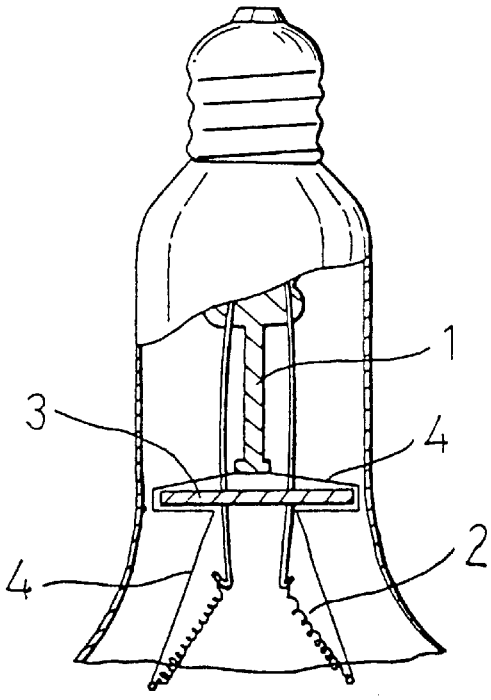
FIG. 4 is a schematically cross-sectional view showing the mounting state of a conventional insulating plate according to the prior art.

As shown in FIGS. 1 to 3, an infrared thermal lamp A according to the present invention includes a base 10, a support rod 12, an insulating plate 13, a filament 18 and a bulb 19. The end of the support rod 12*a*, downwardly extending from a stem 11 of the lower of the base 10, is semi-melted and mounted to the insulating plate 13. An anchoring slot 14 is formed on the center of the insulating plate 13. The upper end or the mouth of the anchoring slot 14 is opened, while the bottom end is closed. Also the diameter of the upper end of the anchoring slot 14 is less than the diameter the bottom end. In the primary embodiment shown in FIGS. 2*a* and 2*b*,the anchoring slot 14 has a conical shape, with the diameter of the upper end of the anchoring slot 14 being less than that of the bottom end. However the shape of the receiving slot 14 may be variously changed as shown in FIG. 3 without affecting the function of this invention.

That is, the end of the support rod 12 in a semi-melted state, as shown in FIG. 2*a*, is inserted into and fills in the anchoring slot 14 of the insulating plate 13. Then, the shape of the melted lower end of the support rod 12, as shown in FIG. 2*b*,is formed into an anchor part having the same shape as the anchoring slot 14 when it is hardened, thus fixedly mounting the insulating plate 13 to the support rod 12. The filament 18 is supported by a lead wire 16, and the lead wire 16 downwardly extends from the stem 11 of the base 10 through a plurality of slits 15, which are formed on the insulating plate 13. Thereafter, the bulb 19 is integrated with the base 10.

As mentioned above, the infrared thermal lamp of this invention allows an insulating plate to be easily mounted to inside of the lamp, thereby simplifying the production process without bending specifically the anchor means. The lamp also saves labor, allows the mounting process of the insulating plate to be automated and conserves the unit cost of production. Furthermore, the anchor means, embedded in the lower end of the support rod, is fixed to the insulating plate in a state that the insulating plate is tightly mounted to the lower end of the support rod, thereby improving work efficiency in the production of the lamps.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An infrared thermal lamp including a filament mounted to the lower end of a support rod downwardly extending from a stem of a base, comprising:

an insulating plate having an anchoring slot at the center for receiving the lower end of the support rod in a semi-melted state, thus being fixedly mounted to said support rod, said anchoring slot being opened at the top end and being closed at the bottom end and having an enlarged diameter at the bottom end.

* * * * *